US007303307B2

(12) United States Patent
Martin et al.

(10) Patent No.: US 7,303,307 B2
(45) Date of Patent: Dec. 4, 2007

(54) ELECTRODELESS LAMP WITH INCORPORATED REFLECTOR

(75) Inventors: Robert Martin, Drummondville (CA); Aline Tétreault, Kingsey Falls (CA); Arunava Dutta, Winchester, MA (US); Daniel Marian, Roscoe, NY (US)

(73) Assignee: Osram Sylvania Inc., Danvers, MA (US)

( * ) Notice: Subject to any disclaimer, the term of this patent is extended or adjusted under 35 U.S.C. 154(b) by 48 days.

(21) Appl. No.: 10/997,035

(22) Filed: Nov. 24, 2004

(65) Prior Publication Data

US 2006/0071590 A1 Apr. 6, 2006

Related U.S. Application Data

(60) Provisional application No. 60/616,371, filed on Oct. 6, 2004.

(51) Int. Cl.
*H01J 1/62* (2006.01)

(52) U.S. Cl. ..... 362/216; 362/263; 313/113; 313/635; 313/161

(58) Field of Classification Search ..... 362/260, 362/113; 313/113, 160, 161, 637, 634, 635, 313/485, 607, 248, 628
See application file for complete search history.

(56) References Cited

U.S. PATENT DOCUMENTS

| | | | | |
|---|---|---|---|---|
| 3,767,956 | A * | 10/1973 | Bauer | 313/485 |
| 4,864,194 | A | 9/1989 | Kobayashi et al. | 315/248 |
| 4,924,141 | A | 5/1990 | Taubner et al. | 313/488 |
| 5,834,905 | A | 11/1998 | Godyak et al. | 315/248 |
| 5,903,095 | A * | 5/1999 | Yoshida et al. | 313/485 |
| 5,923,116 | A * | 7/1999 | Mercer et al. | 313/113 |
| 6,175,197 | B1 | 1/2001 | Kling | 315/248 |
| 6,246,160 | B1 * | 6/2001 | MacLennan et al. | 313/113 |
| 6,288,490 | B1 | 9/2001 | Popov | 313/607 |
| 6,310,442 | B1 | 10/2001 | Vollkommer et al. | 315/246 |
| 6,348,763 | B1 * | 2/2002 | Collins | 313/634 |
| 6,362,570 | B1 | 3/2002 | Popov et al. | 313/634 |
| 6,509,675 | B2 * | 1/2003 | MacLennan et al. | 313/113 |
| 6,522,085 | B2 * | 2/2003 | Popov et al. | 315/248 |
| 6,548,965 | B1 * | 4/2003 | Maya et al. | 315/248 |
| 6,843,585 | B1 * | 1/2005 | Martin et al. | 362/294 |
| 6,890,087 | B2 * | 5/2005 | Ono | 362/260 |
| 2003/0011322 | A1 | 1/2003 | Popov et al. | 315/248 |

FOREIGN PATENT DOCUMENTS

GB 2 356 081 A 10/2001

* cited by examiner

*Primary Examiner*—Thomas M. Sember
(74) *Attorney, Agent, or Firm*—Carlo Bessone

(57) ABSTRACT

An electrodeless lamp (10*a*), wherein the lamp comprises a closed-loop, tubular lamp envelope (13) with parallel cylindrical glass tubes (14*a* 16*a*) containing an arc generating and sustaining medium, means (20*a*) in the form of magnetic toroids for energizing the medium; and a reflector coating (22) associated with the envelope (13) and affixed thereto. In a preferred embodiment of the invention the reflector coating (22) is on the internal surface (24) of the envelope and comprises a layer of a reflective m, such as alumina. Alternatively, the reflective coating (22) can be applied to the external surface of the envelope.

5 Claims, 3 Drawing Sheets

ELECTRODELESS LAMP WITH INCORPORATED REFLECTOR

RELATED APPLICATIONS

This application claims priority based on U.S. Provisional Application Ser. No. 60/616,371 filed Oct. 6, 2004, entitled Electrodeless Fluorescent Lamp With Incorporated Reflector For General Lighting Applications.

TECHNICAL FIELD

This invention relates to electrodeless fluorescent lamps and more particularly to such lamps having a reflector intimately associated with the lamp envelope.

BACKGROUND ART

Fluorescent lamps emit light in all directions; however, in most applications that is not desirable and more than 50% of the light can be wasted. In order to increase the coefficient of light utilization, fixtures employing reflectors are used.

The reflectors are used to recover light that would otherwise be lost (backward lighting), as well as to direct the light where needed (light control).

The reflector design depends upon the application and on lamp geometry and size. The smaller the light source the smaller the reflector and therefore, the smaller the fixture. High output electrodeless lamps (HOEL) are fluorescent lamps that have no electrodes. The discharge in the lamp is generated through a magnetic field coupled through magnetic toroids. The glass vessel of the envelope forms a closed loop and has an overall rectangular shape having two parallel cylindrical glass structures. Such lamps are known and are shown, for example, in U.S. Pat. Nos. 5,834,905 and 6,175,197, the teachings of which are hereby incorporated by reference. The size and shape of these lamps requires relatively large reflectors for two main reason; first, due to the HOEL size and geometry, the reflector must be placed farther away from the lamp to avoid the situation where the reflected light is absorbed by the lamp itself (the farther away from the lamp the larger the reflector needs to be to cover the same solid angle); second is light control. For good light control a light source needs to be a point source. With a point source the direction of the incident light rays is known and the angle of the reflector at each point can be calculated to redirect the light in the proper direction. With a large light source, such as an HOEL, for any given point on the reflector, the incident rays are coming from different directions; therefore, the angle of the reflector at that point can only be a compromise and most of the incident rays will not be redirected in the proper direction. To increase the efficiency and achieve better light control the reflector has to be placed farther away from the lamp; however, this results in a larger fixture.

For economic reasons, as well as aesthetic reasons, a smaller fixture provides many advantages. In many applications, street lighting, for example, the size of the fixture has important cost considerations. As the size of the fixtures increase, so do the weight and the wind resistance, requiring larger mounting posts and larger anchoring with their concomitant cost and labor increases.

The HOEL is an efficient light source; however, due to its size and geometry, large optical systems are required and, therefore, large fixtures. It would be an advance in the art if HOELs could be employed without the disadvantages associated with larger fixtures.

DISCLOSURE OF INVENTION

It is, therefore, an object of the invention to obviate the disadvantages of the prior art.

It is another object of the invention to enhance the usability of HOELs.

These objects are accomplished, in one aspect of the invention, by the provision of an electrodeless lamp comprising; a closed-loop, tubular lamp envelope containing an arc generating and sustaining medium; means for energizing said medium; and a reflector coating associated with said envelope and affixed thereto. Incorporating the reflector directly with the lamp reduces the size and cost of the associated fixture.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
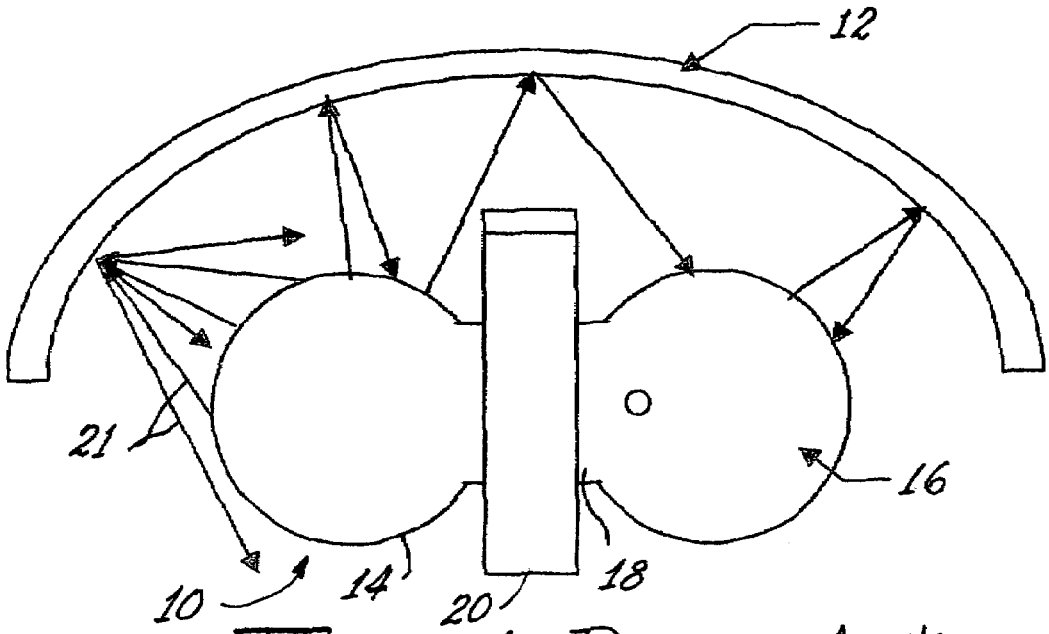
Fig. 1 Prior Art
FIG. 1 is a diagrammatic view of the results of a prior art construction.

Referring now to the drawings with greater particularity, there is shown in FIG. 1 a high output electrodeless lamp (HOEL) 10 mounted adjacent a reflector 12. The lamp 10 comprises parallel cylindrical glass tubes 14, 16, connected at each end by a tube 18. The tubes 18 are surrounded by magnetic toroids 20, as is known. The rectangular shape of the HOEL does not mimic a point source as do most incandescent and arc discharge lamps so that attempts to retrofit an HOEL to a conventional reflector or existing fixture leads to poor light control as shown in FIG. 1, where much of the light emitted by the lamp 10 (illustrated by arrows 21) hits the reflector 12 and is absorbed by the lamp itself instead of being directed outwardly toward its intended illumination field. In the prior art this condition was corrected by moving the reflector farther away from lamp 10; however, this procedure did not allow the lamp to be used with an existing fixtures and made a new fixture an inconvenient size.

This problem has been solved by providing an electrodeless lamp 10*a*, as shown in FIGS. 2-5, wherein the lamp comprises a closed-loop, tubular lamp envelope 13 with parallel cylindrical glass tubes 14*a* 16*a* containing an arc generating and sustaining medium, means 20*a* in the form of magnetic toroids for energizing the medium; and a reflector coating 22 associated with the envelope 13 and affixed thereto.

In a preferred embodiment of the invention the reflector coating 22 is on the internal surface 24 of the envelope and comprises a layer of a reflective material, such as alumina. A preferred material is MgO-free $Al_2O_3$ from Baikowski.

Alternatively, the reflective coating can be applied to the external surface of the envelope.

Figure 2:
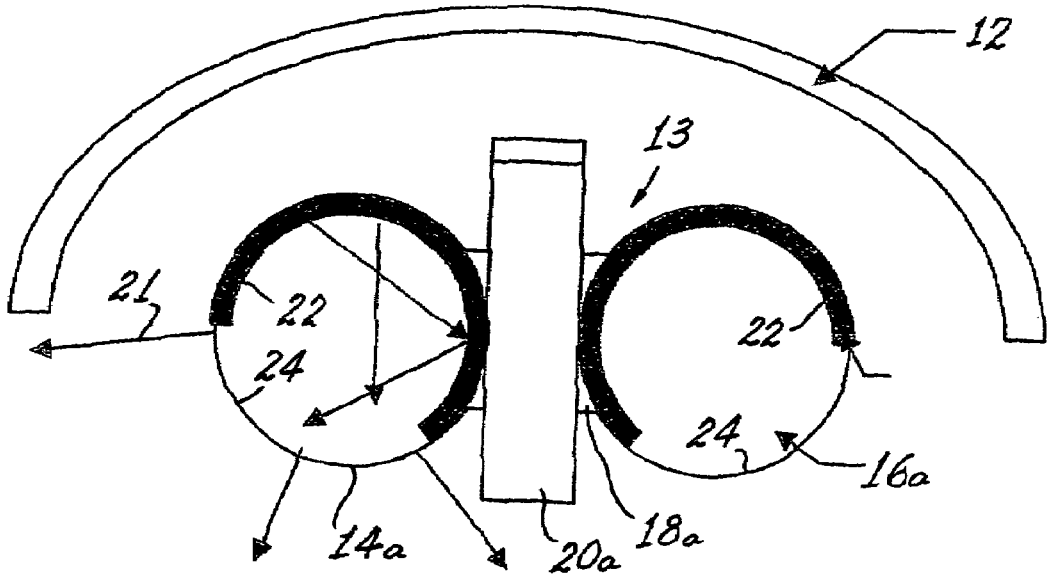
FIG. 2 is a similar view of an embodiment of the invention.
Figure 3:
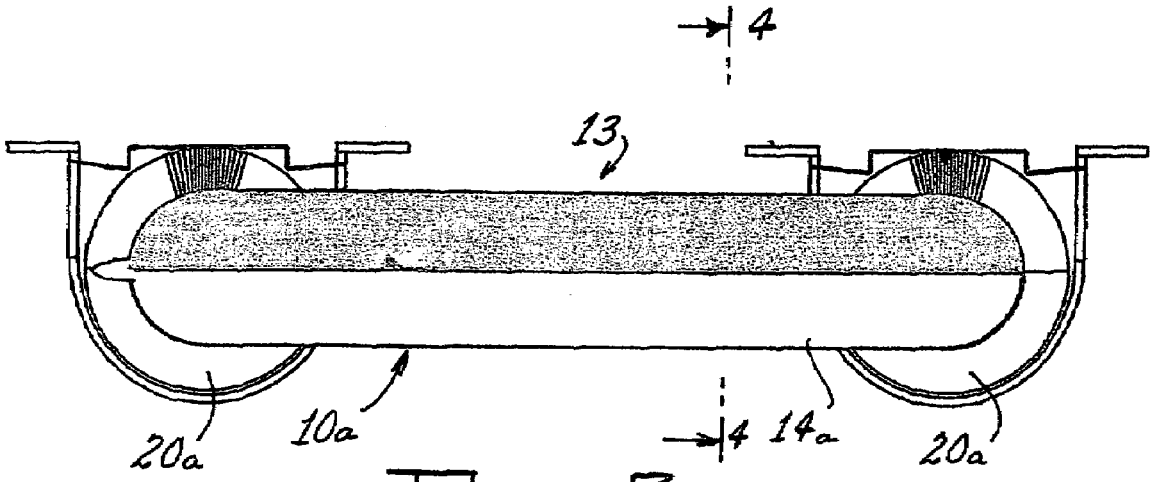
FIG. 3 is a side view of a lamp employing an embodiment of the invention.
Figure 4:
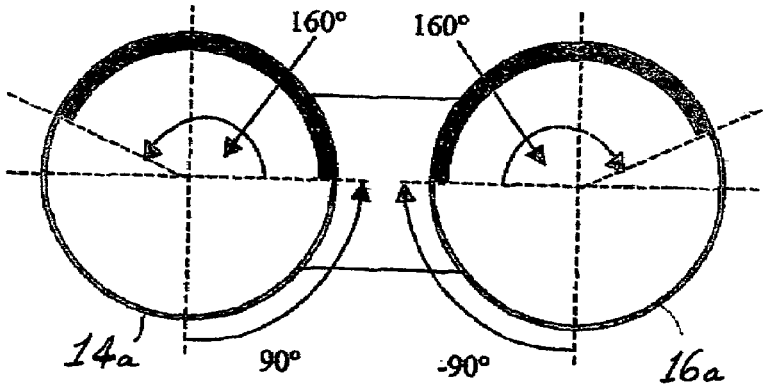
FIG. 4 is a diagrammatic sectional view taken along the line 4-4 of FIG. 3.
Figure 5:
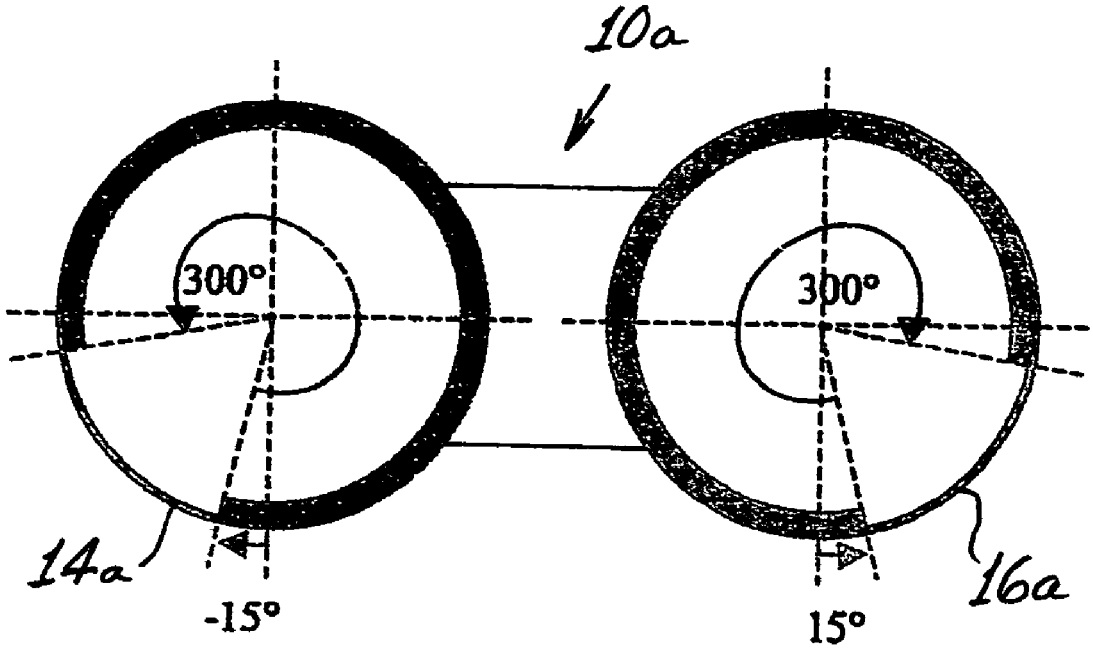
FIG. 5 is a view similar to FIG. 4 illustrating an alternate embodiment of the invention.

The reflective coating 22 preferably covers an angle from 160° to 300° and is positioned such that the reflector coating starts at an angle of between −15° and 90° with respect to a plane parallel to both cylindrical glass tubes 14*a* and 16*a*, as shown in FIGS. 4 and 5. An intermediate coating angle is shown in FIG. 2. The area covered by the coating will depend, of course, on the use to which the lamp is to be put and the fixture with which it will be employed.

The integrated reflector 22 should reflect all light that would otherwise go to the fixture and redirect it toward the desired illumination field. Further, the integrated reflector 22 will prevent light that would be reflected by the fixture's reflector from being absorbed by the lamp itself, thus greatly simplifying light control and increasing the coefficient of light utilization by 50% or more.

Thus, there is provided an electrodeless lamp light source that eliminates the disadvantages of fixture design by providing efficient light utilization without the need for a large optical system in a fixture.

The light reabsorbed by the lamp is substantially decreased and the total light output is increased by a factor of 50% or more. Useable lumens per watt is also increased, thus increasing the efficiency of the lamp.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An electrodeless lamp comprising;

a closed-loop, tubular lamp envelope containing an arc generating and sustaining medium;

means for energizing said medium; and a reflector coating associated with said envelope and affixed thereto, said reflector coating covers a cross-sectional area of said envelope of between 160 and 300 degrees.

2. The electrodeless lamp of claim 1 wherein said reflector coating is positioned on the inner surface of said envelope.

3. The electrodeless lamp of claim 1 wherein said reflector coating is positioned on the external surface of said envelope.

4. The electrodeless lamp of claim 3 wherein said reflector coating is alumina.

5. The electrodeless lamp of claim 1 wherein said reflector coating is alumina.

* * * * *